US011415123B2

(12) United States Patent
Hunter et al.

(10) Patent No.: US 11,415,123 B2
(45) Date of Patent: Aug. 16, 2022

(54) CONTROLLED STOP FOR A PUMP

(71) Applicant: Halliburton Energy Services, Inc., Hosuton, TX (US)

(72) Inventors: Tim H. Hunter, Duncan, OK (US); Stanley V. Stephenson, Duncan, OK (US); Jim Basuki Surjaatmadja, Duncan, OK (US); Billy Don Coskrey, Duncan, OK (US); John C. Reid, Duncan, OK (US)

(73) Assignee: Halliburton Energy Services. Inc., Houston, TX (US)

( * ) Notice: Subject to any disclaimer, the term of this patent is extended or adjusted under 35 U.S.C. 154(b) by 190 days.

(21) Appl. No.: 16/334,535

(22) PCT Filed: Oct. 19, 2016

(86) PCT No.: PCT/US2016/057732
§ 371 (c)(1),
(2) Date: Mar. 19, 2019

(87) PCT Pub. No.: WO2018/075034
PCT Pub. Date: Apr. 26, 2018

(65) Prior Publication Data
US 2020/0309113 A1 Oct. 1, 2020

(51) Int. Cl.
*F04B 49/06* (2006.01)
*F04B 15/02* (2006.01)
(Continued)

(52) U.S. Cl.
CPC ..... *F04B 49/06* (2013.01); *F04B 15/02* (2013.01); *F04B 17/03* (2013.01); *F04B 49/225* (2013.01); *F04B 53/10* (2013.01)

(58) Field of Classification Search
CPC ..... F04B 11/0091; F04B 15/02; F04B 23/02; F04B 23/025; F04B 23/06; F04B 49/06;
(Continued)

(56) References Cited

U.S. PATENT DOCUMENTS 4,149,827 A * 4/1979 Hofmann, Jr. ..... F04C 28/24 417/12
4,953,618 A * 9/1990 Hamid ..... E21B 33/068 166/250.01
(Continued)

FOREIGN PATENT DOCUMENTS

CA 1335552 C 5/1995
EP 0170387 A1 2/1986
EP 0319745 A2 6/1989

OTHER PUBLICATIONS

Author: KB Title: Sizing a Minimum Flow Recirculation Line Date Published (mm/dd/yyyy): Aug. 13, 2013 Date accessed (mm/dd/yyyy): Nov. 18, 2020 Link: http://kb.eng-software.com/eskb/files/1442094/1704159/1/1409284222000/Sizing+a+Minimum+Flow+Recirculation+Line+old.pdf (Year: 2013).*
(Continued)

*Primary Examiner* — Charles G Freay
*Assistant Examiner* — Chirag Jariwala
(74) *Attorney, Agent, or Firm* — Conley Rose, P.C.; Rodney B. Carroll

(57) ABSTRACT

Certain conditions require powering down an engine driving a pump. During the down sequence the pump may continue pumping servicing fluid which may not be desirable. Activating one or more control valves may throttle or prevent the servicing fluid from being pumped from the pump during the power down sequence. Activation of an input control valve may introduce pressurized fluid into a cylinder of the pump extending a rod to force or maintain a suction valve in an open position. While the suction valve is in the open
(Continued)

position, the stroke of the plunger may not create enough pressure to pump the servicing fluid causing the servicing fluid to flow between a fluid header and a chamber of the pump. Activation of an output control valve may divert servicing fluid pumped from the pump to a reservoir instead of to the desired location.

15 Claims, 4 Drawing Sheets

(51) Int. Cl.
*F04B 53/10* (2006.01)
*F04B 49/22* (2006.01)
*F04B 17/03* (2006.01)

(58) Field of Classification Search
CPC ..... F04B 49/22; F04B 49/225; F04B 49/24; F04B 49/246; F04B 49/243; F04B 1/0476; F04B 1/0538; F04B 17/03; F04B 17/06; F04B 15/00; F04B 23/028; F04B 23/04; F04B 49/02; F04B 49/03; F04B 49/20; F04B 49/065; F04B 49/035; F04B 53/10
USPC ..... 417/223, 298, 415, 283, 288, 296, 303, 417/304, 307, 308, 428, 440, 26–31, 446, 417/27
See application file for complete search history.

(56) References Cited

U.S. PATENT DOCUMENTS

| | | | | |
|---|---|---|---|---|
| 5,980,225 | A | 11/1999 | Summer | |
| 5,984,353 | A | 11/1999 | Rasmussen | |
| 6,073,653 | A * | 6/2000 | Nishio | G05D 7/0688 137/486 |
| 2002/0001523 | A1* | 1/2002 | Tsuru | F04C 28/24 417/53 |
| 2004/0191081 | A1* | 9/2004 | Schmidt | F16N 7/385 417/307 |
| 2007/0065302 | A1 | 3/2007 | Schmitz | |
| 2008/0066915 | A1 | 3/2008 | Shampine | |
| 2009/0041588 | A1* | 2/2009 | Hunter | F04B 7/0076 417/27 |
| 2009/0250552 | A1 | 10/2009 | Kearns et al. | |
| 2010/0183448 | A1 | 7/2010 | Leugemors et al. | |
| 2010/0300683 | A1* | 12/2010 | Looper | E21B 21/06 166/250.01 |
| 2014/0294619 | A1 | 10/2014 | Mangiagli | |
| 2016/0177683 | A1* | 6/2016 | Hodges | E21B 43/121 166/250.15 |
| 2016/0195082 | A1* | 7/2016 | Wiegman | F04B 49/065 417/63 |
| 2016/0369609 | A1* | 12/2016 | Morris | F04B 17/06 |

OTHER PUBLICATIONS

International Search Report and Written Opinion issued in related PCT Application No. PCT/US2016/057732 dated Jul. 13, 2017, 15 pages.

* cited by examiner

CONTROLLED STOP FOR A PUMP

CROSS-REFERENCE TO RELATED APPLICATION

The present application is a U.S. National Stage Application of International Application No. PCT/US2016/057732 filed Oct. 19, 2016, which is incorporated herein by reference in its entirety for all purposes.

TECHNICAL FIELD

The present disclosure relates generally to a controlled stop for a pump and, more particularly, to rapid stop of high horsepower, direct drive, electric pumps, for example, pumps used for well stimulation.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Positive displacement pumps, for example, reciprocating pumps, are used in all phases of well servicing operations including to pump water, cement, fracturing fluids, and other stimulation or servicing fluids as well as other pumping operations. During a well service operation, a condition may occur (for example, an overpressure condition) or a test may be desired to be ran that requires a rapid or substantially instantaneous stop of an operational pump. For pumps driven by a diesel engine, the transmission could disengage the clutch and power to the pump would be stopped causing the pump to stop substantially instantaneously. For pumps driven by an electric motor or powertrain, however, kinetic energy stored in the rotor is so high such that it can cause damage to the electric motor or power train, other structures or the surrounding environment if the electric motor or powertrain is shutdown too quickly.

Some specific exemplary embodiments of the disclosure may be understood by referring, in part, to the following description and the accompanying drawings.

Figure 1:
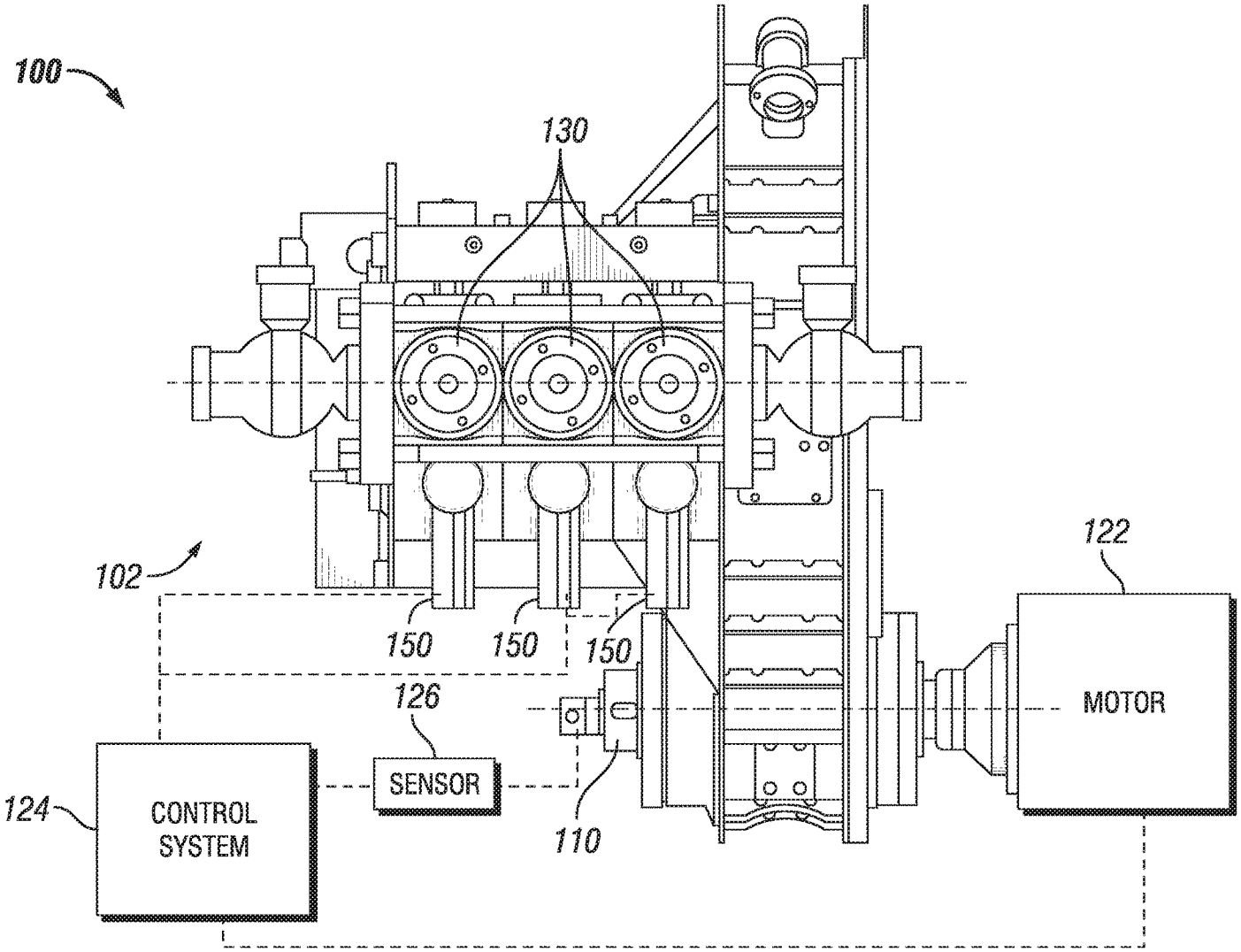
FIG. 1 is a front view of a pumping system, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to a controlled stop for a pump and, more particularly, to rapid stop of high horsepower, direct drive, electric pumps, for example, pumps used for well stimulation. Generally, diesel engines may be used to drive one or more pumps, for example, one or more pumps for performing well servicing operations such as stimulating a wellbore. Conditions at the well site may require that any one or more pumps be stopped immediately or substantially instantaneously to prevent damage to the pump, the motor or powertrain driving the pump, surrounding equipment or environment. For example, an overpressure condition may occur or an operator may require that one or more tests be ran. With a diesel engine, the clutch could be disengaged from the transmission stopping substantially instantaneously the driving of the pump. However, diesel engines may not be suitable for a given well site environment due to operational characteristics of the diesel engine, for example, control over pump rate, exhaust emissions and noise emissions. An electric motor or powertrain may provide the operational characteristics required for a given well site environment. However, electric motors or powertrains comprise a rotor that may have substantial weight that is not easily during operation without causing damage to the equipment. One or more aspects of the present disclosure provide for decoupling the kinetic energy stored in the rotor from the downstream pressurized fluid system (for example, the pump) without overpressuring the downstream pressurized fluid system.

In one or more aspects of the present disclosure, a well site operation may utilize an information handling system to control one or more operations including, but not limited to, a motor or powertrain, a downstream pressurized fluid system, or both. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "1*a*" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments of the present disclosure may be applicable to drilling operations that include but are not limited to target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

FIG. 1 is a front view of a pumping system 100, according to one or more aspects of the present disclosure. Pumping system 100 comprises a pump 102, for example, a positive displacement pump, with a valve system 150. A pump 102 may comprise multiple chambers 130 with plungers driven by a single crankshaft 110. By way of example only, pump 110 as illustrated comprises three chambers 130 connected to a common crankshaft 110. For each chamber 130 of pump 102, the crankshaft 110 drives a plunger (see, for example, plunger 220 in FIG. 2) located within the chamber 130. The chamber 130 includes a suction valve (not shown) and a discharge valve (not shown). The suction valve connects a servicing fluid source to pump 102. Pump 102 pressurizes the servicing fluid and pumps or discharges to the servicing fluid via a flow line (for example, flow line 222 in FIG. 2) to a desired location. Servicing fluid source may comprise any type of servicing fluid for any type of application. For example, in a well servicing application, a servicing fluid may comprise a well servicing fluid that may include, but is not limited to, any one or more of water, fracturing or stimulation fluid, mud, slurry, and any other fluid required to be pumped to a wellbore or downhole. The pump 102 is coupled to a motor (or powertrain) 122 that drives the crankshaft 110 for powering the pump 102. In one or more embodiments, the motor 122 comprises an electric motor. The motor 122 may be coupled to control system 124. Control system 124 may control the speed of the motor 122 and the actuation of the valve system 150. Control system 124 may be coupled to a sensor 126 that couples to the pump 102 to measure one or more characteristics of the pump 102. In one or more embodiments, control system 124 may comprise any one or more information handling systems and may be directly or indirectly coupled to any one or more components of the pumping system 100. In one or more embodiments, each of a plurality of control systems 124 may be communicatively coupled to each other and may be coupled to one or more different components of pumping system 100. In one or more embodiments, control system 124 is located remotely from the pumping system 100.

Figure 2:
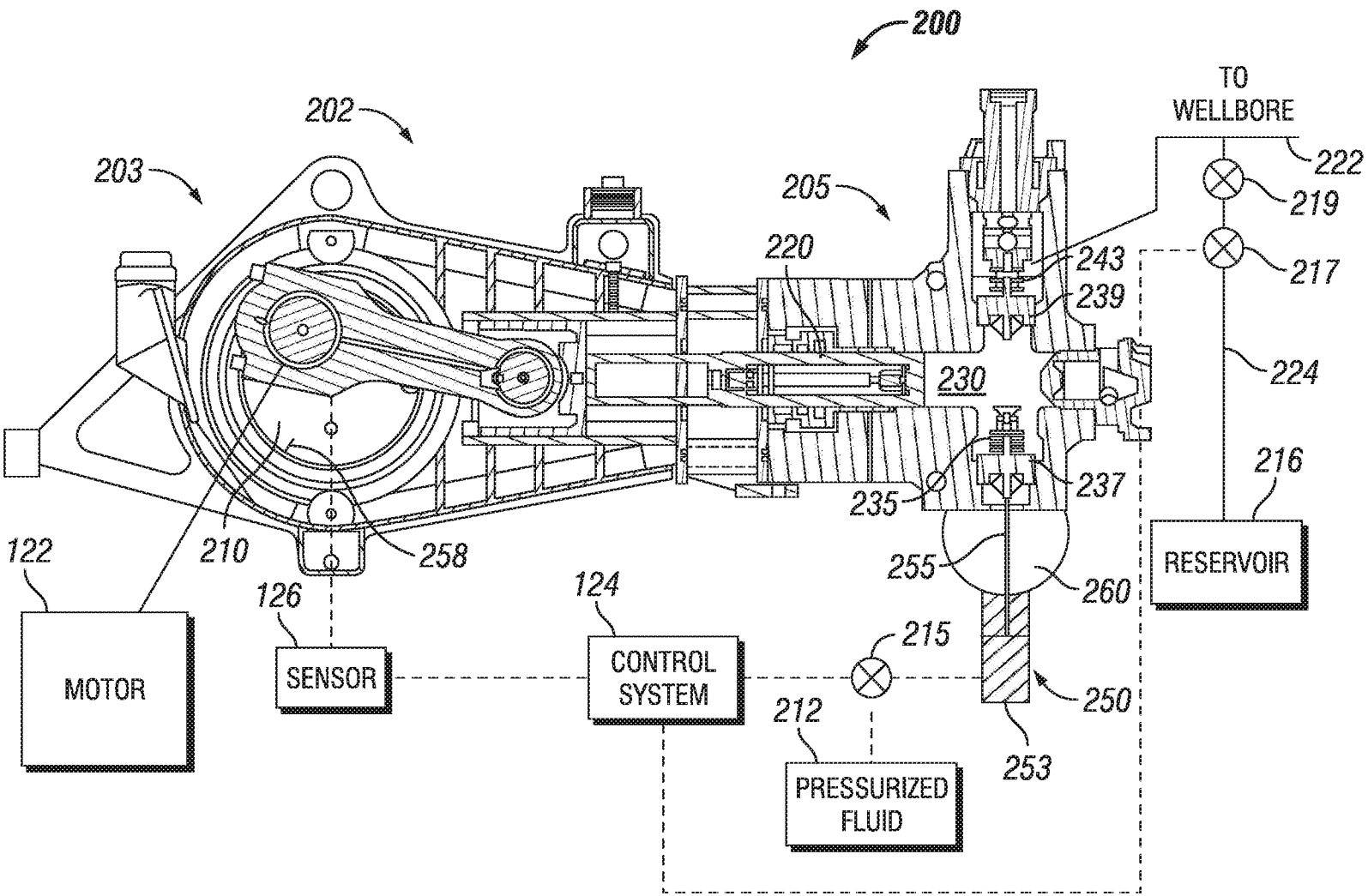
FIG. 2 is a cross-section of a representative chamber in a pump of a pumping system, according to one or more aspects of the present disclosure.

FIG. 2 is a cross-section of a representative chamber 230 in a pump 202 of a pumping system 200, according to one or more aspects of the present disclosure. Pump 202 comprises a positive displacement pump. Pump 202 comprises a power end 203 that includes a crankshaft 210 that drives the plunger 220 and a fluid end 205 that includes a compression chamber 230 into which well servicing fluid flows through the suction valve 237 to be pumped out through the discharge valve 239 under pressure as the plunger 220 extends into the chamber 230. The suction valve 237 and the discharge valve 239 may be any type of valve, actuator, flap, gate, inlet, tap, faucet, any other type of device which controls the flow of a fluid, or any combination thereof. Pump 202 comprises a valve train 250 that provides a force directed to open the suction valve 237, a sensor 126 for detecting pump stroke position, velocity or both (for example, based on a location of timing marker 258) and a control system 124.

Control system 124 may receive information (for example, pump stroke information) from the sensor 126. Control system 124 may be coupled to the valve train 250 and may activate or deactivate the valve train 250 based, at least in part, on the received information. For a multi-chamber pump, any one or more sensors 126 and one or more control systems 124 may operate the valve train 250 for each chamber 230. In one or more embodiments, each chamber 230 is associated with a different sensor 126, a different control system 124, or both. In one or more embodiments, any one or more chambers 230 may be associated with any one or more sensors 126, any one or more control systems 124, or both. In one or more embodiments, the valve train 250 may be controlled manually or mechanically.

The valve train 250 comprises a cylinder 253 with a rod 255 interacting with the suction valve 237 of the pump 202. The cylinder 253 that drives the rod 255 to operate the suction valve 237 may be hydraulic, pneumatic (or powered by some other gas) or electric or any other suitable type of cylinder. Rod 255 provides a force when extended on the suction valve 237 causing the suction valve to open (for example, by pushing the suction valve 237 from a seat of the suction valve 237). The valve train 250 may provide a force that opens the suction valve 237. During a discharge or compression stroke, pressure inside the chamber 230 is high causing suction valve 237 to close. Forces created by valve train 250 are generally not sufficient to counteract this closure force during the discharge stroke. As soon as the plunger 220 retracts, pressure inside the chamber 230 lowers or becomes very low and suction valve 237 opens. At this time the rod 255 extends and prevents the suction valve 237 from closing disabling the pump 202 or preventing the pumping of fluid from the pump 202. Output flow of the pump 202 via flow line 222 is therefore stopped completely, even though any one or more mechanisms of the pump 202 continue to operate. As the pump 202 is disabled or no longer pumping, the motor 122 may be ramped down or stopped gradually without causing any damage to the motor 122, the pump 202 or any other equipment or surrounding environment.

A closure member of the valve train 250 may provide the closing force to the suction valve 237. A closure member may include, but is not limited to, suction valve spring 235, compressed gas (such as air) cylinder, a hydraulic system with gas-filled accumulator, a gravity or buoyancy based closure member, or any combination thereof. In one or more embodiments, the suction valve spring 235 is compressed as the suction valve 237 opens which provides a closing force on the suction valve 237. As the rod 255 extends (when the valve train 250 provides an opening force to the suction valve 237), the suction valve spring 235 resists in compression (since the suction valve is biased closed by the suction valve spring 235). When the valve train 250 releases the opening force (by the rod 255 retracting, for example) during the discharge stroke, the suction valve spring 235, chamber pressure, or both provide a force directed to close the suction valve 237 (a closing force).

The cylinder 253 is mounted to the fluid header 260. The fluid header 260 brings well servicing fluid to be pumped by the pump 202 from a fluid source to the suction valve 237, and the rod 255 extends through an appropriately sealed opening in the fluid header 260 to interact mechanically with the suction valve 237. As the rod 255 extends, it provides a force to open the suction valve 237, and when the rod 255 later releases this opening force, it allows the suction valve 237 to close under the influence of the suction valve spring 235, chamber pressure or both during the discharge stroke of the pump 202.

In one or more embodiments, the operation of the valve train 250 may be timed using a feedback signal from one or more sensors 126. The one or more sensors 126 may be coupled, directly or indirectly, to the pump 202 at one or more locations of the pump 202 and may sense one or more operational parameters of the pump 202. For example, the one or more operational parameters may comprise detection of a pump stroke and pressure. A sensor 126 may detect the pump stroke of pump 202 based on a timing marker 258 and may transmit this information to the controller 124 so that the controller 124 may determine when the plunger 220 has completed a suction stroke, when the plunger 220 has completed a discharge stroke, or when the plunger 220 is in any other one or more positions as appropriate to properly time the activation of the valve train 250 to open, close or both the suction valve 237 according to a given operation, for example, a well services operation. A sensor 126 may also detect an overpressure condition requiring a stoppage or a power down sequence of the motor 122 and a release of any fluid in pump 202.

During the suction stroke, the suction valve 237 should be open (with the suction valve 237 away from its seat), allowing fluid from the fluid header 260 to enter the chamber 230 through the suction valve 237. The discharge valve 239 of pump 202 would be closed under the influence of discharge valve spring 243 and line pressure during the suction stroke. Pressure in the chamber 230 will vary during suction and discharge strokes depending upon the position of the plunger 220 in the chamber 230 and the amount and type of servicing fluid (and possibly other material) in the chamber 230. During the discharge stroke, the suction valve 237 should generally be closed, preventing fluid in the chamber 230 from exiting via the suction valve 237 so that as pressure in the chamber 230 builds (due to compression by the plunger 220), the discharge valve 239 opens (as the discharge valve spring 243 is compressed away from its seat), and fluid in the chamber 230 is pumped under pressure out the discharge valve 239.

During one or more well servicing operations or other types of operations, it may be necessary, required or part of job plan or workflow to stop instantaneously or substantially instantaneously the pumping of the pressurized well servicing fluid, for example, to prevent or relieve an overpressure condition or to allow for one or more testing procedures. The motor 122, for example, an electric motor, may require a power down sequence that stops, brakes, or ramps down the speed of the electric motor gradually to prevent damage to the electric motor, other equipment or the surrounding environment. However, during this power down sequence (which generally is not an instantaneous or substantially instantaneous power stoppage of the motor 122) the pump 202 may continue pumping due to kinetic energy in the motor 122. One or more control valves, for example, input control valve 215 and output control valve 217, may be activated to prevent or throttle the pressurized well servicing fluid from being pumped by pump 202 to the wellbore via flow line 222 during such a power down sequence of the motor 122.

In one or more embodiments, an input control valve 215 may be communicatively, electrically, mechanically or otherwise coupled to the control system 124 and coupled to the cylinder 253 or valve train 250. Input control valve 215 may be activated and deactivated by the control system 124. In one or more embodiments, any one or more conditions may occur that require a power down sequence of the motor 122. For example, one or more conditions may include, but are not limited to, an overpressure condition (such as an overpressure condition detected by sensor 126), a testing procedure, or any other condition requiring stoppage of pressurized well servicing fluid being pumped to the wellbore or downhole.

In one or more embodiments, the control system 124 may initiate a pumping sequence to prevent or throttle the flow of pressurized well services fluid from the pump 202 based, at least in part, on detection of a power down sequence of the motor 122 (for example, information from sensor 126 may be indicative of a power down sequence of the motor 122), one or more operator inputs, information from sensor 126 (for example, information from sensor 126 may be indicative of an overpressure condition), a flag, alert, semaphore, program instruction or timed interval (for example, testing procedures may be scheduled), or any other indicator. In one or more embodiments, the control system 124 may be coupled to motor 122 and may send a signal or command to the motor 122 to initiate a power down sequence.

Once the power down sequence for the motor 122 has begun, the control system 124 initiates a pumping sequence for the pump 202 to prevent or throttle the flow of pressurized well services fluid from the pump 202. The control system 124 may receive information from sensor 126 that indicates that the plunger 220 has initiated or begun a suction stroke (causing the suction valve 237 to open). The control system 124 may transmit a signal or a command to the input control valve 215 to activate the input control valve 215. Once the input control valve 215 is activated, pressurized fluid 212 is flowed into the cylinder 253 to activate (for example, via hydraulic pressure or gas pressure) the rod 255 of cylinder 253. The pressurized fluid 212 may comprise any type of fluid or gas, for example, Nitrogen. The pressurized fluid 212 causes the rod 255 to extend and engage with the suction valve 237 to maintain the suction valve 237 in an open position, for example, via a hydraulic pressure or a gas pressure. As the suction valve 237 is maintained in an open position during each suction and discharge stroke, any pressurized well servicing fluid in the pump 202 circulates between the fluid header 260 and the chamber 230 instead of being pumped out flow line 222. The control system 124 may deactivate the input control valve 215 to stop the flow of pressurized fluid 212 to the valve train 250 or the cylinder 253, allowing the suction value 237 to open and close during each stroke so that pressurized well servicing fluid is pumped out flow line 222 to the wellbore.

In one or more embodiments, an output control valve 217 may be coupled to the control system 124 and the flow line 222. In one or more embodiments, a choke 219 may be coupled between the output control valve 217 and the flow line 222. The output control valve 217 may couple via a flow line 224 to a reservoir 216. Reservoir 216 may comprise a container, tank, pit or any other receptacle for containing and retaining a servicing fluid, for example, a well servicing fluid. In one or more embodiments, one or more conditions may occur that require diversion of the pressurized well servicing fluid from the wellbore to a reservoir 216. One or more conditions may include, but are not limited to, plugging in the well, a screenout, an overpressure condition, an emergency condition any other condition requiring instantaneous or substantially instantaneous throttling or prevention of the pumping of pressurized well services fluid to the wellbore or downhole. Once the power down sequence is detected or initiated as discussed above, the control system 124 may activate the output control valve 217 diverts the pressurized well services fluid to reservoir 216. In one or more embodiments, a choke 219 may control the flow of the pressurized well services fluid to the reservoir 216.

Figure 3A:
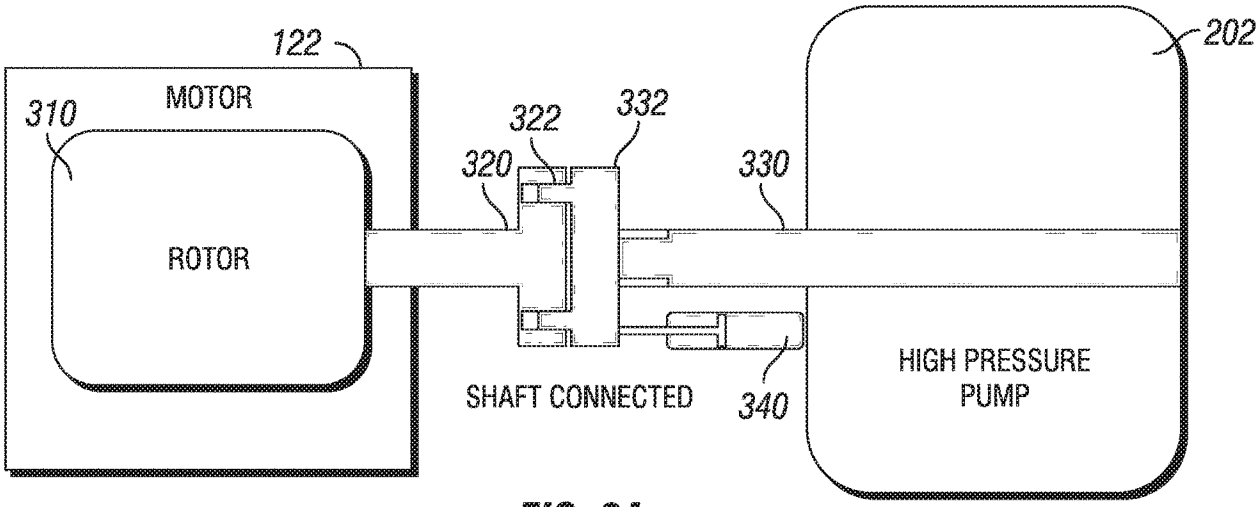
FIG. 3A is a diagram illustrating a disconnect for a pumping system, according to one or more aspects of the present disclosure.
Figure 3B:
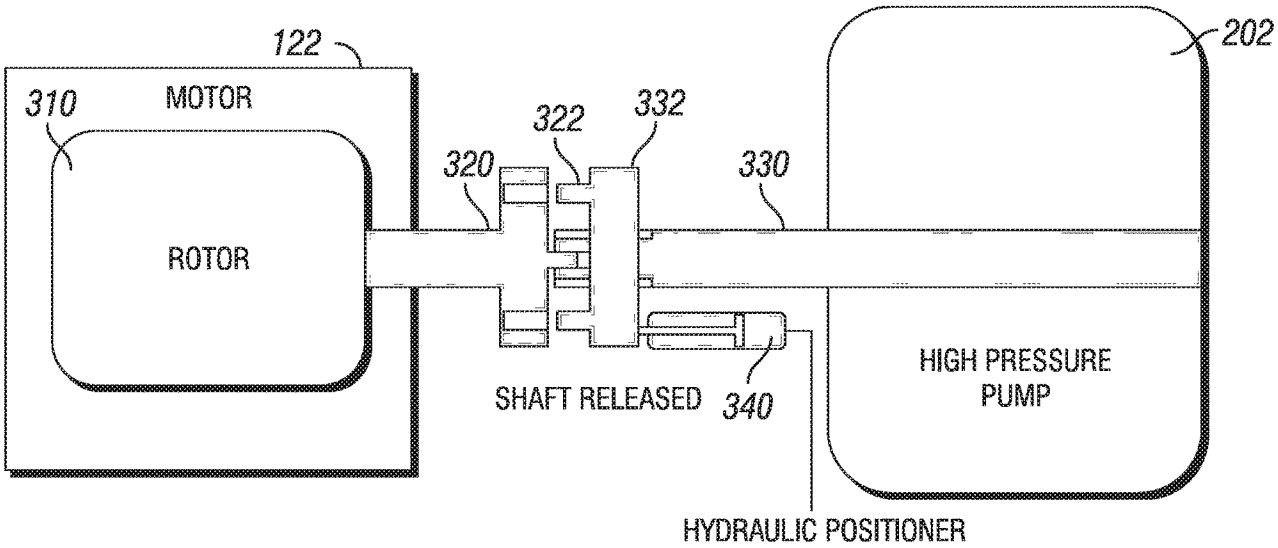
FIG. 3B is a diagram illustrating a disconnect for a pumping system, according to one or more aspects of the present disclosure.

FIG. 3A is a diagram illustrating a disconnect for a pumping system, according to one or more aspects of the present disclosure. In one or more embodiments, a rotor 310 of an motor 122 is coupled to a drive shaft 320. Drive shaft 320 may comprise a drive shaft connector 322. The drive shaft 320 drives a pump shaft 330 coupled to a high pressure pump 202. Pump shaft 330 may comprise a pump shaft connector 332. Pump shaft connector 332 engages with or otherwise releasably couples to drive shaft connector 322. A hydraulic positioner 340 may be coupled to the pump shaft connector 332. When a power down sequence of the motor 122 is initiated or detected as discussed above, a hydraulic cylinder (for example, the primary component of hydraulic positioner 340) of the hydraulic positioner 340 is contracted to disengage or disconnect the pump shaft connector 332 and pump shaft 330 from the drive shaft connector 322 and the drive shaft 320 as illustrated in FIG. 3B. In one or more embodiments, the hydraulic positioner may be coupled to the control system 124 and the control system 124 may activate the hydraulic cylinder (cause the cylinder of the hydraulic positioner 340). In one or more embodiments, the hydraulic positioner 340 may be utilized in conjunction with input control valve 215 and output control valve 217 as discussed herein.

While well servicing fluid is discussed with one or more embodiments, the present disclosure contemplates that any type of servicing fluid may be utilized. The present disclosure contemplates that any one or more embodiments are suitable for any one or more types of operations that require instantaneous or substantially instantaneous prevention of throttling of the discharge of a pressurized fluid from a pump.

In certain embodiments, the control system 124 may comprise an information handling system with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Figure 4:
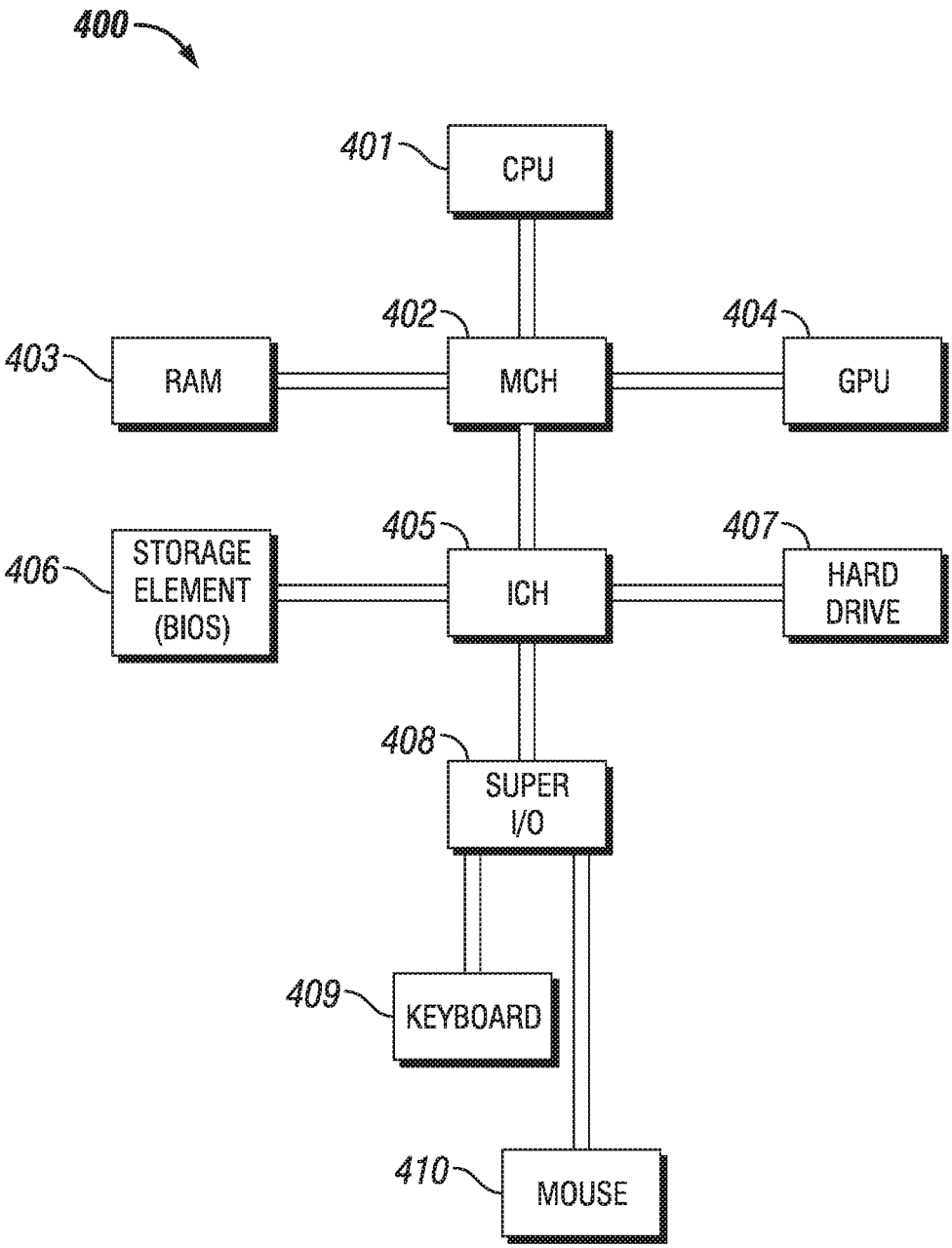
FIG. 4 is a diagram illustrating an example information handling system, according to aspects of the present disclosure.

FIG. 4 is a diagram illustrating an example information handling system 400, according to aspects of the present disclosure. The control system 124 may take a form similar to the information handling system 400. A processor or central processing unit (CPU) 401 of the information handling system 400 is communicatively coupled to a memory controller hub or north bridge 402. The processor 401 may include, for example a microprocessor, microcontroller, digital signal processor (DSP), application specific integrated circuit (ASIC), or any other digital or analog circuitry configured to interpret and/or execute program instructions and/or process data. Processor 401 may be configured to interpret and/or execute program instructions or other data retrieved and stored in any memory such as memory 403 or hard drive 407. Program instructions or other data may constitute portions of a software or application for carrying out one or more methods described herein. Memory 403 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software program or an application may be retrieved and stored in memory 403 for execution by processor 401.

Modifications, additions, or omissions may be made to FIG. 4 without departing from the scope of the present disclosure. For example, FIG. 4 shows a particular configuration of components of information handling system 400. However, any suitable configurations of components may be used. For example, components of information handling system 400 may be implemented either as physical or logical components. Furthermore, in some embodiments, functionality associated with components of information handling system 400 may be implemented in special purpose circuits or components. In other embodiments, functionality associated with components of information handling system 400 may be implemented in configurable general purpose circuit or components. For example, components of information handling system 400 may be implemented by configured computer program instructions.

Memory controller hub (MCH) 402 may include a memory controller for directing information to or from various system memory components within the information handling system 400, such as memory 403, storage element 406, and hard drive 407. The memory controller hub 402 may be coupled to memory 403 and a graphics processing unit 404. Memory controller hub 402 may also be coupled to an I/O controller hub (ICH) or south bridge 405. I/O hub 405 is coupled to storage elements of the information handling system 400, including a storage element 406, which may comprise a flash ROM that includes a basic input/output system (BIOS) of the computer system. I/O hub 405 is also coupled to the hard drive 407 of the information handling system 400. I/O hub 405 may also be coupled to a Super I/O chip 408, which is itself coupled to several of the I/O ports of the computer system, including keyboard 409 and mouse 410.

In one or more embodiments, a pumping system comprises a pump, wherein the pump comprises a suction valve through which fluid is drawn into a chamber during a suction stroke and a valve train having a cylinder with a rod disposed in the cylinder, an input control valve coupled to the valve train, wherein the input control valve is activatable and a pressurized fluid fluidically coupled to the cylinder via the input control valve to extend the rod to maintain the suction valve in an open position to prevent or throttle discharge of a fluid from the pump during a power down sequence. In one or more embodiments, the pumping system further comprises a control system coupled to the input control valve, a sensor coupled to the pump and the control system and wherein the control system activates the input control valve based, at least in part, on information received from the sensor. In one or more embodiments, the pumping system further comprises a fluid header, wherein the cylinder is mounted to the fluid header and a servicing fluid source, wherein the servicing fluid source provides a servicing fluid to the fluid header for pumping by the pump, and wherein the rod extends through a sealed opening in the fluid header. In one or more embodiments, the pumping system further comprises a flow line coupled to the pump, wherein the flow line flows discharged pressurized servicing fluid from the pump to a location and an output control valve coupled to the flow line, wherein the activation of the output control valve causes the servicing fluid to be diverted to a reservoir. In one or more embodiments, the pumping system further comprises a choke coupled between the output control valve and the flow line, wherein the choke controls the flow of servicing fluid to the reservoir. In one or more embodiments, the servicing fluid is a gas. In one or more embodiments, the servicing fluid is a well servicing fluid.

In one or more embodiments, a method for preventing or throttling discharge of a servicing fluid from a pump comprises activating an input control valve coupled to a valve train of the pump, flowing pressurized fluid to the valve train, maintaining a suction valve of the pump in an open position based, at least in part, on the pressurized fluid and throttling or preventing discharge of the servicing fluid from the pump. In one or more embodiments, the method further comprises receiving information from a sensor coupled to the pump, wherein the information is indicative of a power down sequence of a motor. In one or more embodiments, the method further comprises extending a rod of a cylinder of the drive train, wherein the cylinder receives the pressurized fluid, and wherein the extended rod maintains the suction valve in the open position. In one or more embodiments, the method further comprises sensing a suction stroke of a plunger of the pump and wherein the input control valve is activated during the suction stroke. In one or more embodiments, the method further comprises circulating the servicing fluid between a fluid header and a chamber of the pump. In one or more embodiments, the method further comprises activating an output control valve to divert the servicing fluid to a reservoir. In one or more embodiments, the method further comprises controlling the diversion of the servicing fluid via a choke coupled to the output control valve. In one or more embodiments, the method further comprises activating a hydraulic positioner to disengage a pump shaft of the pump from a motor shaft of the motor.

In one or more embodiments, a non-transitory computer readable medium storing one or more instructions that, when executed, cause a processor to activate an input control valve to cause a pressurized fluid to flow to a valve train of the pump, maintain a suction valve of the pump in an open position via the pressurized fluid and throttling or preventing discharge of the servicing fluid from the pump and throttle or prevent discharge of a servicing fluid from the pump via the suction valve in the open position. In one or more embodiments, the one or more instructions, when executed, further cause the processor to receive information from a sensor coupled to the pump, wherein the information is indicative of a power down sequence of a motor. In one or more embodiments, the one or more instructions, when executed, further cause the processor to sense a suction stroke of a plunger of the pump and wherein the input control valve is activated during the suction stroke. In one or more embodiments, the one or more instructions, when executed, further cause the processor to activate an output control valve to divert the servicing fluid to a reservoir. In one or more embodiments, the one or more instructions, when executed, further cause the processor to activate a hydraulic positioner to disengage a pump shaft of the pump from a motor shaft of the motor.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A pumping system, comprising:

a pump, wherein the pump comprises:

a suction valve through which a servicing fluid is drawn into a chamber during a suction stroke; and a valve train having a cylinder with a rod disposed in the cylinder; and a pump shaft operably coupled to a drive shaft of a rotor, wherein the pump shaft comprises a pump shaft connector;

a positioner coupled to the pump shaft connector;

an electric motor coupled to the pump operable to drive a crankshaft for powering the pump;

a control system communicatively coupled to the electric motor and to the pump;

an input control valve coupled to the valve train, wherein the input control valve is disposed upstream of the pump, wherein the input control valve is activatable based on a command transmitted by the control system indicating a power down sequence for the electric motor, wherein the command is transmitted based on received information from a sensor coupled to the pump;

a pressurized fluid fluidically coupled to the cylinder via the input control valve operable to extend the rod to maintain the suction valve in an open position to prevent or throttle discharge of the servicing fluid from the pump during the power down sequence, wherein the input control valve is configured to maintain the suction valve in the open position by allowing the pressurized fluid to flow into the cylinder to actuate the rod, wherein the input control valve is configured to deactivate to stop the flow of the pressurized fluid to the cylinder in order to release an opening force provided on the suction valve during a discharge stroke, wherein the positioner is operable to disconnect the pump shaft from the drive shaft through contraction when the power down sequence is detected;

a first flow line coupled to the pump, wherein the first flow line is operable to direct discharged pressurized servicing fluid from the pump to a wellbore; and an output control valve coupled to a second flow line, wherein the second flow line is connected to the first flow line, wherein activation of the output control valve causes the discharged pressurized servicing fluid to be diverted from the first flow line to a reservoir through the second flow line, wherein the output control valve is communicatively coupled to the control system.

2. The pumping system of claim 1, further comprising:

the control system coupled to the input control valve;

the sensor coupled to the pump and the control system; and wherein the control system activates the input control valve based, at least in part, on information received from the sensor.

3. The pumping system of claim 1, further comprising:

a fluid header, wherein the cylinder is mounted to the fluid header; and a servicing fluid source, wherein the servicing fluid source provides the servicing fluid to the fluid header for pumping by the pump, and wherein the rod extends through a sealed opening in the fluid header.

4. The pumping system of claim 1, wherein the sensor is operable to detect a pump stroke position, velocity, or both.

5. The pumping system of claim 1, further comprising a choke coupled between the output control valve and the first flow line, wherein the choke controls the flow of discharged pressurized servicing fluid to the reservoir.

6. The pumping system of 1, wherein the pressurized fluid is a gas.

7. A method of initiating a pumping sequence of a pump, comprising:

determining a power down sequence of an electric motor with a control system, wherein the control system is communicatively coupled to the electric motor and to the pump;

activating an input control valve coupled to a valve train of the pump based on a command transmitted by the control system in response to determining the power down sequence for the electric motor, wherein the input control valve is disposed upstream of the pump, wherein the command is transmitted based on received information from a sensor coupled to the pump;

flowing pressurized fluid to the valve train;

maintaining a suction valve of the pump in an open position based, at least in part, on the input control valve allowing the pressurized fluid to flow into a cylinder, with a rod disposed in the cylinder, to actuate the rod;

throttling or preventing discharge of a servicing fluid from the pump;

disconnecting a pump shaft from a drive shaft via a positioner based on the determination of the power down sequence, wherein the positioner is operable to contract to disconnect the pump shaft from the drive shaft;

deactivating the input control valve to stop the flow of the pressurized fluid to the cylinder in order to release an opening force provided on the suction valve during a discharge stroke; and activating an output control valve to divert the servicing fluid from a first flow line to a reservoir, wherein the output control valve is coupled to a second flow line, wherein the second flow line is connected to the first flow line, wherein the output control valve is communicatively coupled to the control system.

8. The method as claimed in claim 7, further comprising controlling the diversion of the servicing fluid via a choke disposed between the output control valve and the first flow line.

9. The method as claimed in claim 7, further comprising receiving information from the sensor coupled to the pump, wherein the information is indicative of a detected pump stroke position, velocity, or both.

10. The method as claimed in claim 7, further comprising extending the rod of the cylinder of the valve train, wherein the cylinder receives the pressurized fluid, and wherein the extended rod maintains the suction valve in the open position.

11. The method as claimed in claim 7, further comprising:

sensing a suction stroke of a plunger of the pump; and wherein the input control valve is activated during the suction stroke.

12. The method as claimed in claim 7, further comprising circulating the servicing fluid between a fluid header and a chamber of the pump.

13. A non-transitory computer readable medium storing one or more instructions that, when executed, cause a processor to:

determine a power down sequence of an electric motor;

activate an input control valve to cause a pressurized fluid to flow to a valve train of a pump based on a command transmitted by a control system in response to determining the power down sequence for the electric motor, wherein the command is transmitted based on received information from a sensor coupled to the pump, wherein the input control valve is disposed upstream of the pump, wherein the valve train comprises a cylinder with a rod disposed in the cylinder, wherein the pressurized fluid flows into the cylinder to actuate the rod;

maintain a suction valve of the pump in an open position via the pressurized fluid; and throttle or prevent discharge of a servicing fluid from the pump via the suction valve in the open position;

disconnect a pump shaft from a drive shaft via a positioner based on the determination of the power down sequence, wherein the positioner is operable to contract to disconnect the pump shaft from the drive shaft;

deactivate the input control valve to stop the flow of the pressurized fluid to the cylinder in order to release an opening force provided on the suction valve during a discharge stroke; and activate an output control valve to divert the servicing fluid from a first flow line to a reservoir, wherein the output control valve is coupled to a second flow line, wherein the second flow line is connected to the first flow line, wherein the output control valve is communicatively coupled to the control system.

14. The non-transitory computer readable medium of claim 13, wherein the one or more instructions, when executed, further cause the processor to receive information from the sensor coupled to the pump, wherein the information is indicative of a detected pump stroke position, velocity, or both.

15. The non-transitory computer readable medium of claim 13, wherein the one or more instructions, when executed, further cause the processor to:

sense a suction stroke of a plunger of the pump; and wherein the input control valve is activated during the suction stroke.

* * * * *